US005213930A

United States Patent [19]

Yamana et al.

[11] Patent Number: 5,213,930

[45] Date of Patent: May 25, 1993

[54] ELECTROPHOTOGRAPHIC LITHOGRAPH PRINTING PLATE MATERIAL HAVING A MIXTURE OF SENSITIZING DYES

[75] Inventors: Masahiro Yamana, Tokyo; Koji Sato, Kodaira, both of Japan

[73] Assignee: Oji Paper Co., Ltd., Tokyo, Japan

[21] Appl. No.: 783,439

[22] Filed: Oct. 28, 1991

[30] Foreign Application Priority Data

Nov. 26, 1990 [JP] Japan ..... 2-317894
Feb. 18, 1991 [JP] Japan ..... 3-23138

[51] Int. Cl.[5] ..... G03G 5/08; G03G 5/09

[52] U.S. Cl. ..... 430/92; 430/93

[58] Field of Search ..... 430/89, 92, 93

[56] References Cited

U.S. PATENT DOCUMENTS 4,657,836 4/1987 Franke et al. ..... 430/93
4,879,195 11/1989 Toyotuku et al. ..... 430/92
4,929,527 5/1990 Kato et al. ..... 430/92

FOREIGN PATENT DOCUMENTS 0194624 9/1986 European Pat. Off. .
0288083 10/1988 European Pat. Off. .
0321284 6/1989 European Pat. Off. .
0430597 6/1991 European Pat. Off. .
62-220962 9/1987 Japan .

*Primary Examiner*—John Goodrow
*Attorney, Agent, or Firm*—Armstrong, Westerman, Hattori, McLeland & Naughton

[57] ABSTRACT

An electrophotographic lithograph printing plate material having an enhanced sensitivity to laser rays, an excellent heat resistance and a low dark decay comprises an electroconductive, water-resistant substrate and an electrophotographic layer comprising a photoconductive zinc oxide, a resinous binder and a sensitizing dye material which comprises at least one compound (A) of the formula (I) and at least one compound (B) of the formula (II):

(I)

(II)

wherein each of $A_1$ and $A_2$ represents a $C_{5-7}$ polymethine group non-substituted or substituted with at least one substituent, for example, —Cl, the substituted polymethine group may have a cyclic structure, for example, of:

each of from $B_1$ to $B_4$ is a divalent non-substituted or substituted, benzene or naphthalene group, each of from $X_1$ to $X_4$ is a S, Se, or O atom or a $—C(CH_3)_2—$ group, each of from $R_1$ to $R_4$ is a $C_{1-5}$ alkyl group, each of $M_1$ and $M_5$ is a metal atom, organic base or hydrogen atom, each of $Y_1$ and $Y_2$ is an anion, and m and n is zero or 1 but when n=1, m=1 and when n=0, m=0 and $—R_3COO$ group adjacent to the $(M_1)_m$ group in the formula (II) is anionic, the weight ratio of the compound (A) to the compound (B) being 3:1 to 20:1.

7 Claims, No Drawings

ELECTROPHOTOGRAPHIC LITHOGRAPH PRINTING PLATE MATERIAL HAVING A MIXTURE OF SENSITIZING DYES

BACKGROUND OF THE INVENTION

1) Field of the Invention

The present invention relates to an electrophotographic lithograph printing plate material.

More particularly, the present invention relates to an electrophotographic lithograph printing plate material having an enhanced sensitivity to semiconductor laser rays.

2) Description of the Related Arts

Generally, a conventional electrophotographic lithograph printing plate material has a photosensitive electrophotographic layer wherein electroconductive zinc oxide particles are dispersed as a photoconductive material. This type of lithograph printing plate material (known as a zinc oxide offset master material) is widely employed in the light printing industry, because it is cheap and because the process for making a printing plate from the material is simple and easy.

In a conventional process for producing a lithograph printing plate from the above-mentioned printing plate material, a visible light-irradiation source, for example, a halogen lamp, is used. In this process, the visible light is irradiated to and reflected on an original image or picture and the reflected rays are irradiated to the photosensitive surface of the printing plate material. This method is referred to as a camera system printing plate-making method.

Due to the recent development of various recording machines and the spread of data digitalization, a computer-to-plate type printing plate-making method is now widely used for the electrophotographic material. In this method, laser rays that can be controlled in accordance with computer data are applied to the photosensitive printing plate material surface as a scanning exposure.

Among the laser rays, semiconductor laser rays, which can be generated in a small size device and can be directly modulated, are most useful.

The zinc oxide offset master usable for the semiconductor laser rays is made from a lithograph printing plate material having a photosensitive electrophotographic layer spectrosensitized by a sensitizing dye and having an enhanced sensitivity at a wave-length of 700 to 1000 nm, particularly 780 nm, of the semiconductor laser rays.

Zinc oxide per se exhibits a spectrosensitivity only at a wavelength of about 400 nm. Therefore, to provide a electrophotographic layer having a satisfactory spectrosensitivity at a wavelength of about 780 nm, various sensitizing dye compounds are utilized.

For example, Japanese Unexamined Patent Publication No. 62-220962 discloses sensitizing dye material consisting of cyanine dye compounds having alkylsulfonic acid groups attached, as substituents, to nitrogen atoms located at both terminal portions of the compound molecule. An example of the cyanine dye compounds has the following formula:

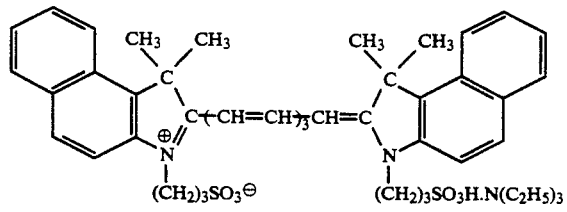

The above-mentioned sensitizing dye compounds effectively enhance the spectrosensitivity of the electrophotographic layer when employed together with a chemical sensitizing agent, but this type of electrophotographic lithograph printing material is disadvantageous in that the electrophotographic layer exhibits an undesirably large dark decay in the surface potential thereof.

The procedures for preparing a lithograph printing plate by using laser rays are usually carried out in a continuous system (note, an intermittent system is used by the camera system printing plate-making method) without stopping the printing plate material. Therefore, the effect of the enhanced dark decay is not serious in the continuous printing plate-making method. Nevertheless, when the line speed of the continuous printing plate-making procedure is low, the enhanced dark decay does become a serious problem.

As an example of sensitizing dye compounds exhibiting a small dark decay and a high sensitivity, a compound of the following formula:

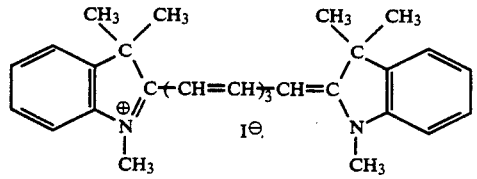

wherein the nitrogen atoms located at two terminal portions of the dye molecule are substituted by alkyl groups, is known, and this type of sensitizing dye compound is available under the trademark of NK 125, from Nihon Kankoshikiso Kenkyusho.

This type of the sensitizing dye compound, however, has a disadvantage in that it causes the resultant lithograph printing material to exhibit a low heat resistance, and this has an adverse affect on the durability of the resultant lithograph printing material when transported or stored under high temperature conditions. Namely, the commercial value of the lithograph printing material is often significantly reduced by the above-mentioned lower heat-resistance.

Many attempts have been made to provide a sensitizing dye material capable of imparting an industrially satisfactory sensitivity, dark decay resistance and heat resistance to the electrophotographic layer, but these previous attempts did not succeed in obtaining a sensitizing dye material composed of a single dye compound and having all of the above-mentioned properties.

SUMMARY OF THE INVENTION

An object of the present invention is to provide an electrophotographic lithograph printing plate material having a high sensitivity to semiconductor laser rays, a high heat resistance, and a low dark decay.

The above-mentioned object can be attained by the electrophotographic lithograph printing plate material of the present invention, comprising an electroconductive, water-resistant substrate and an electrophotographic layer formed on at least one surface of the substrate and comprising a photoconductive zinc oxide powder, resinous binder and a sensitizing dye material, the sensitizing coloring material comprising a mixture of a sensitizing dye component (A) consisting of at least one compound of the formula (I) and a sensitizing dye component (B) consisting of at least one compound of the formula (II):

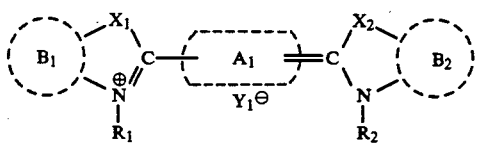

(I)

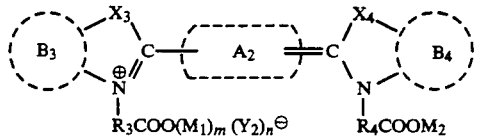

(II)

in which formulae (I) and (II), $A_1$ and $A_2$ respectively and independently represent a polymethine chain group having 5 to 7 carbon atoms, and non-substituted or substituted with at least one substituent, in which substituted polymethine chain group, two of the substituents may form, together with three carbon atoms in the polymethine chain group, a cyclic structure including 6 or more carbon atoms bonded to each other, $B_1$, $B_2$, $B_3$ and $B_4$ respectively and independently represent a member selected from the group consisting of divalent benzene and naphthalene groups non-substituted or substituted with at least one substituent, $X_1$, $X_2$, $X_3$ and $X_4$ respectively and independently represent a member selected from S, Se and O atoms and $—C(CH_3)_2—$ group, $R_1$, $R_2$, $R_3$ and $R_4$ respectively and independently represent an alkyl group having 1 to 5 carbon atoms, $M_1$ and $M_2$ respectively and independently represent a member selected from the group consisting of metal atoms, organic bases and a hydrogen atom, $Y_1$ and $Y_2$ respectively and independently represent an anion, and m and n respectively and independently represent zero or an integer of one but when n is an integer of one, m is an integer of one, and when n is zero, m is also zero and the $—R_3COO$ group adjacent to the $(M_1)_m$ group in the formula (II) is anionic, the weight ratio of the sensitizing dye component (A) to the sensitizing dye component (B) being from 3:1 to 20:1.

In the electrophotographic lithograph printing plate material of the present invention the sensitizing dye material to be contained in the electrophotographic layer must comprise a mixture of the sensitizing dye component (A) consisting of at least one specific compound of the formula (I) with the sensitizing dye component (B) consisting of at least one specific compound selected from those of the formula (II), in a specific weight ratio thereof.

DESCRIPTION OF THE PREFERRED EMBODIMENTS

In the electrophotographic lithograph printing plate material of the present invention, the use of the specific sensitizing dye material effectively controls the dark decay in the surface potential of the electrophotographic layer to a practically satisfactory level, and enhances the heat resistance of the electrophotographic layer to a level at which the sensitivity of the layer is not greatly changed by a heat treatment test at a temperature of 60° C. for 30 days.

In particular, it should be noted that the dye compounds of the formula (II) have an excellent heat resistance and exhibit a very high sensitizing effect, and thus can be utilized without using a sensitizing assistant. Nevertheless, those compounds undesirably cause the resultant electrophotographic layer to exhibit a high dark decay and a narrow exposure latitude, and accordingly, the employment of those compounds alone is not satisfactory in practice.

In the present invention, by adjusting the weight ratio of the sensitizing dye component (A) to the sensitizing dye component (B) to 3:1 to 20:1, the resultant sensitizing dye material causes the resultant electrophotographic layer to exhibit a satisfactory heat resistance and storage and transportation durability, and an excellent laser-ray-sensitivity, even when a sensitizing assistant is not used.

Accordingly, it can be assumed that the dye compounds (B) of the formula (II) serve as a sensitizing dye, and as a sensitizing assistant for the sensitizing dye compound (A) of the formula (I).

With respect to the heat resistance of the electrophotographic layer, it is assumed that the reduction in the sensitivity of the electrophotographic layer due to a heat treatment is derived from a desorption of the dye compound from zinc oxide particles in the layer, rather than from a heat-decomposition of the dye compound, and accordingly, it is assumed that the dye compounds (B) of the formula (II) serve as a promoter for an adsorption of the dye compounds (A) of the formula (I) by the zinc oxide particles.

With respect to the dark decay in the electrophotographic layer, since the proportion of the sensitizing dye component (A) consisting of the dye compound of the formula (I) in the mixture of the sensitizing dye components (A) and (B) is significantly high, the dark decay property of the electrophotographic layer is mainly controlled by the sensitizing dye component (A) therein, and thus the resultant electrophotographic layer of the present invention exhibits a satisfactory dark decay resistance.

The present invention enables the use of a sensitizing assistant (chemical sensitizing agent) to be omitted, and thus is advantageous in that the resultant electrophotographic layer of the present invention is free from the adverse influence of the sensitizing assistant.

The electrophotographic layer of the present invention may optionally contain an additive other than the sensitizing agent, for example, phthalic anhydride, dinitrobenzoic acid or manganese chloride, which are effective for improving the contrast of the images and for reducing the background fogging.

The heat resistance of the electrophotographic lithograph printing plate material is measured in the following manner.

A test piece of the printing plate material is placed in a light-shielding bag and the bag is hermetically sealed. The test piece in the light-shielding bag is treated in a hot air-circulating dryer at a temperature of 60° C. for 3 days and then left to stand in a room temperature atmosphere for one day.

The treated test piece is then subjected to a measurement of the spectral sensitivity thereof at a wavelength of 780 nm. The measurement result is represented by an half value exposure energy (Eh). A ratio in % of the measured half value exposure energy of the heat treated test piece to that of non-heat treated test piece is referred to as an increase in the half value exposure energy. Thus, the larger the increase in the half value exposure energy, the lower the heat resistance of the lithograph printing plate material.

The compounds of the formula (I) usable for the present invention are preferably selected from the compounds of the formula (IV) to (IX):

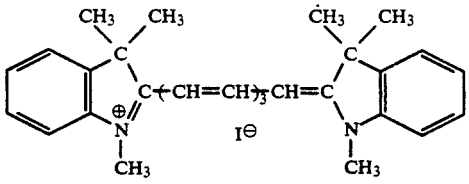
(IV)

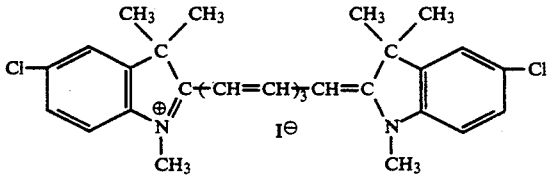
(V)

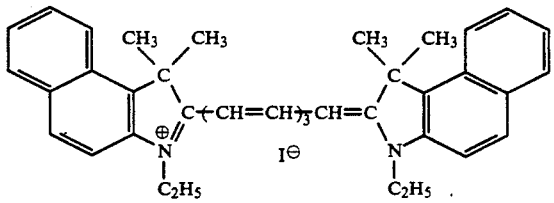
(VI)

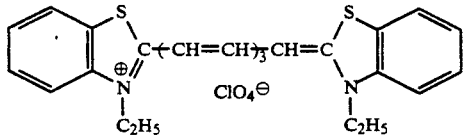
(VII)

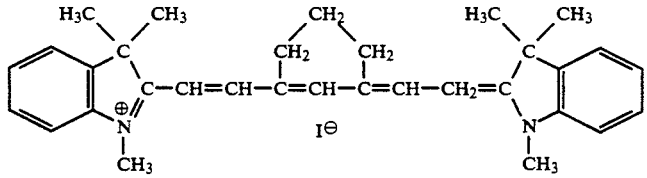
(VIII)

and

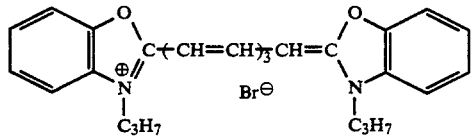
(IX)

The compounds of the formula (II) usable for the present invention are preferably selected from those of the formulae (X) to (XVII):

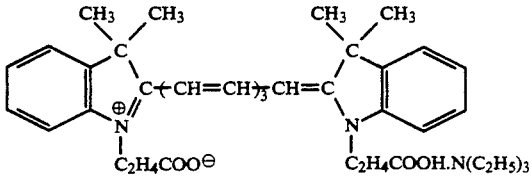
(X)

-continued (XI)

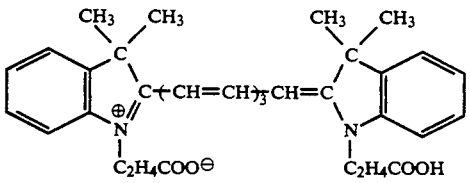

(XII)

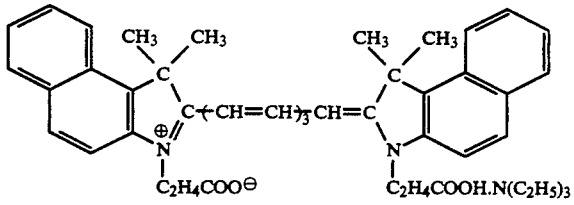

(XIII)

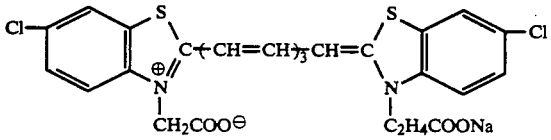

(XIV)

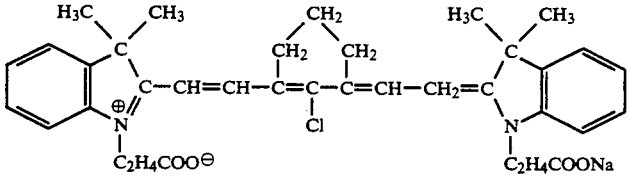

(XV)

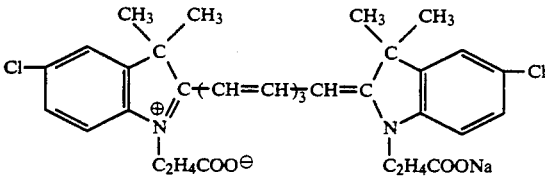

(XVI)

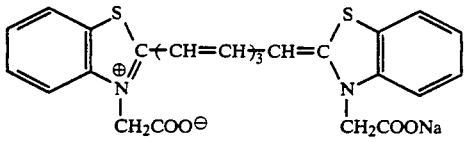

and (XVII)

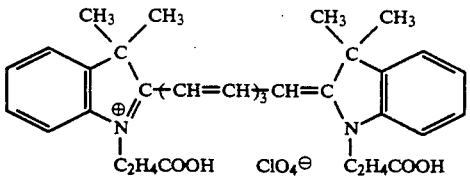

The total amount of the sensitizing dye components (A) and (B) is variable in accordance with the level of sensitivity required of the electrophotographic layer. Preferably, the total amount of the sensitizing dye component (A) and (B) is from 0.01 to 0.06%, based on the dry solid weight of the electrophotographic layer.

In the present invention, the weight ratio of the sensitizing dye component (A) to the sensitizing dye component (B) must be from 3:1 to 20:1, as when this weight ratio is more than 20:1, the resultant electrophotographic layer exhibits an unsatisfactory heat resistance due to an excessively large content of the sensitizing dye component (A). Also, if this weight ratio is less than 3:1, the resultant electrophotographic layer exhibits an undesirably enhanced dark decay, an excessively increased sensitivity, and thus a narrowed exposure latitude, due to an excessively large content of the sensitizing dye component (B).

The zinc oxide powder usable for the electrophotographic layer of the present invention exhibits a photoconductive property, and preferably has a particle size of 0.1 to 0.5 μm.

Usually, the photoconductive zinc oxide powder is contained in an amount of 70 to 90% based on the dry solid weight of the electrophotographic layer.

The resinous binder usable for the electrophotographic layer comprises a single resinous material or a mixture of two or more resinous materials. There is no specific limitation of the type of resinous materials, as long as such resinous materials have a film-forming property sufficient for bonding the zinc oxide particles and other components therewith, and do not affect the photoconductivity of the zinc oxide.

The resinous binder preferably comprises an oil-soluble acrylic resin. The oil-soluble acrylic resin is selected from, for example, those available under the trademark of LR-188, from Mitsubishi Rayon Co., and of Acrydic A-405 from Dainihon Ink Chemical Industry Co.

Preferably, the resinous binder is contained in a solid content of 10 to 30%, more preferably 12 to 25%, based on the weight of the photoconductive zinc oxide powder, in the electrophotographic layer.

In the preparation of a coating liquid for forming the electrophotographic layer, the necessary components are dissolved or dispersed in a solvent comprising, for example, toluene, 2-butanone and butyl acetate. The most preferable solvent is toluene, due to its appropriate vaporizing rate and relatively small odor.

The support usable for the present invention must have a satisfactory electroconductivity and water resistance. The support is formed from a member selected from electroconductive, water-resistant paper sheets, composite sheets each comprising a core paper sheet and at least one aluminum foil or electroconductive polymeric sheets laminated on the core paper sheet, and metallized paper sheets prepared, for example, by a metal vapor deposition method.

Preferably, the support has a thickness of 100 to 170 μm, and the lithograph printing plate material has a total thickness of 130 to 200 μm.

To enhance the water-resistance of the lithograph printing plate material of the present invention, and to control the electroconductivity of the printing plate material, a water-resistant intermediate layer is optionally arranged between the substrate and the electrophotographic layer.

The water-resistant intermediate layer preferably contains a water soluble polymeric material, for example, polyvinyl alcohol, casein or starch, an emulsion of a synthetic resin, for example, acrylic ester copolymer, or SBR, a curing agent, for example, melamine-formaldehyde resin, glyoxal or silane-coupling compound, a pigment, for example, clay, silica or electroconductive mica, an inorganic salt and/or an electroconductive agent, for example, polystyrene-sulfonic acid.

The intermediate layer has a dry solid weight of 5 to 15 g/m$^2$.

When the substrate is composed of a paper sheet, a back coating layer is optionally arranged on a back surface of the substrate, to prevent a penetration of water into the substrate and to impart desired mechanical properties to the substrate. The back coating layer can be formed from the same materials as those used for the intermediate layer. Preferably, the back coating layer has a dry solid weight of 5 to 20 g/m$^2$.

In the production of the electrophotographic lithograph printing plate material of the present invention, an electroconductive zinc oxide powder, a sensitizing dye components (A) and (B), a resinous binder and optionally, a sensitizing assistant, each in a predetermined amount, are mixed with a solvent consisting of, for example, toluene, and the mixture is finely dispersed by using a mix-dispersing machine, for example, a ball mill, sand grinder or paint shaker, to provide a coating liquid for forming the electrophotographic layer.

The coating liquid is applied directly to a surface of a substrate or to an intermediate layer surface formed on the substrate, and the coating liquid layer is dried to form an electrophotographic layer.

The thickness of the electrophotographic layer contributes to the electrophotographic property thereof, and thus preferably is from 5 to 25 μm, more preferably from 10 to 20 μm.

The lithographic printing plate can be produced from the electrophotographic lithograph printing plate material by subjecting the electrophotographic layer to a corona-discharge treatment and then to an imagewise scanning exposure to semiconductor laser rays in accordance with digital data, to provide electrostatic latent images thereon, developing the latent images by using a liquid developing agent, and heat-fixing the resultant visible images on the printing plate surface.

When the resultant printing plate is used for an offset printing procedure, the electrophotographic layer surface having the images is treated with a conversion liquid containing, for example, sodium ferrocyanide, to make the non-image portions of the surface hydrophilic.

The treated printing plate is fixed to an offset printing machine and used for printing.

EXAMPLES

The specific examples presented below will more fully elaborate on the ways in which the present invention can be practically used. It should be understood, however, that the examples are only illustrative and in no way limit the scope of the present invention.

In the examples, the part and % are by weight unless otherwise indicated.

EXAMPLE 1

A coating liquid for an electrophotographic layer was prepared by mixing the following components, in the order indicated below, in a rotation stirrer.

| Component | Trademark | Part by weight |
|---|---|---|
| Toluene | — | 80 |
| Acrylic resin | LR-188 (40% conc.) (Mitsubishi Rayon Co.) | 50 |
| Zinc oxide | SA ZEX #2000 (Sakai Kagaku Kogyo K.K.) | 80 |
| Sensitizing dye component (A) | Compound of formula (IV) | 0.02 |
| Sensitizing dye component (B) | Compound of formula (XI) | 0.002 |
| Methylalcohol | | 3 |

The dye components (A) and (B) were used in the form of a solution in methyl alcohol.

The mixture was dispersed by a sand grinder to provide a coating liquid.

A substrate composed of a composite sheet made by laminating an electroconductive-treated paper sheet having a basis weight of 80 g/m$^2$ with an aluminum foil having a thickness of 10 μm was used.

The coating liquid was applied to the aluminum foil surface of the support sheet and dried to form an electrophotographic layer having a basis weight of 25 g/m$^2$.

An electrophotographic lithograph printing plate material was obtained, and was subjected to a printing plate-making procedure by employing a laser plate-maker made by Toppan Insatsu K. K., to provide a lithograph printing plate with a test pattern of images.

The resultant printing plate had clear images, and after treating with a customary conversion liquid, the treated printing plate was used for an offset printing. The resultant prints had a satisfactory clarity.

The dark decay resistance and heat resistance of the lithograph printing plate material were tested in the following manner.

(A) The dark decay resistance was measured by the following method.

The surface of the printing plate material was charged at a potential of −5 kV, by using an EPA device, and an initial potential value ($P_1$) of the printing plate material surface immediately after the charging was measured. Also, a potential value ($P_2$) of the material surface at 60 seconds after the charging was measured. The resistance of the printing plate material to dark decay was represented by a ratio ($P_2/P_1$) in % of the potential value ($P_2$) 60 seconds after the charging to the initial potential value ($P_1$).

The larger the ratio ($P_2/P_1$), the higher the dark decay resistance.

(B) The heat resistance test was carried out by the following method.

An initial spectral sensitivity ($S_1$) of the printing plate material was measured at a spectral band of 780 nm in an Synthia device by employing an outside light source.

A test piece of the printing plate material was hermetically sealed in a black colored bag, heat treated at a temperature of 60° C. for 72 hours in a heated atmosphere, and then removed from the bag and left to stand in the dark at room temperature for one day. Then the spectral sensitivity ($S_2$) of the heat-treated test piece was measured in the same manner as mentioned above.

The measured sensitivity values were respectively converted to a corresponding half value exposure energy E1/2 in erg/cm$^2$.

A ratio of the half value exposure energy ($S_2$) of the heat treated printing plate material to the initial half value exposure energy ($S_2$) of the non-treated printing plate material was calculated.

The calculated ratio in % was referred to as an increase in the half value exposure energy. The larger the increase in the half value exposure energy, the lower the heat resistance.

The results of the tests are shown in Table 1.

EXAMPLE 2

The same procedures for producing an electrophotographic lithograph printing plate material as in Example 1 were carried out except that the sensitizing dye component (A) was composed of 0.025 part by weight of a compound of the formula (V), and the sensitizing dye component (B) was composed of 0.002 part by weight of a compound of the formula (XI).

The printing plate material was subjected to a printing plate-making procedure by employing a laser platemaker made by Toppan Insatsu K. K., to provide a lithograph printing plate with a test pattern of images.

The resultant printing plate had clear images. The printing plate was treated with a conversion liquid and used for an offset printing. The resultant prints had a satisfactory clarity.

The test results are indicated in Table 1.

EXAMPLE 3

The same procedures for producing an electrophotographic lithograph printing plate material as in Example 1 were carried out except that the sensitizing dye component (A) was composed of 0.02 part by weight of a compound of the formula (VIII), and the sensitizing dye component (B) was composed of 0.002 parts by weight of a compound of the formula (XVII).

The printing plate material was subjected to a printing plate-making procedure by employing a laser platemaker made by Toppan Insatsu K. K., to provide a lithograph printing plate with a test pattern of images.

The resultant printing plate had clear images. The printing plate was treated with a conversion liquid and used for an offset printing. The resultant prints had a satisfactory clarity.

The test results are indicated in Table 1.

COMPARATIVE EXAMPLE 1

The same procedures for producing an electrophotographic lithograph printing plate material as in Example 1 were carried out except that only the sensitizing dye component (A) composed of 0.025 part by weight of a compound of the formula (IV), was used, the sensitizing dye component (B) was omitted, and 0.05 parts by weight of a sensitizing assistant consisting of pyromellitic anhydride was added to the coating liquid.

The test results are shown in Table 1.

COMPARATIVE EXAMPLE 2

The same procedures for producing an electrophotographic lithograph printing plate material as in Example 1 were carried out except that the sensitizing dye component (A) was omitted and only the sensitizing dye component (B) composed of 0.04 parts by weight of a compound of the formula (XI) was used.

The test results are shown in Table 1.

TABLE 1

| Example No. | Item | Dark decay resistance (Surface potential ratio $P_2/P_1$, %) | Heat resistance (Increase in half value of exposure, %) |
|---|---|---|---|
| Example | 1 | 78.0 | 1.03 |
| Example | 2 | 79.2 | 1.04 |
| Example | 3 | 81.5 | 1.06 |
| Comparative Example | 1 | 85.0 | 2.56 |
| Comparative Example | 2 | 34.6 | 0.88 |

Table 1 clearly indicates that the lithograph printing plate materials of Examples 1 to 3 exhibit an excellent heat resistance and a satisfactory dark decay resistance in practical use, whereas the printing plate material of Comparative Example 1, from which the sensitizing dye component (B) was omitted, had a poor heat resistance, and the printing plate material of Comparative Example 2, from which the sensitizing dye component (A) was omitted, had a poor dark decay resistance.

We claim:

1. An electrophotographic lithograph printing plate material comprising an electroconductive, waterresistant substrate and an electrophotographic layer formed on at least one surface of the substrate and comprising a photoconductive zinc oxide powder, a resinous binder and a sensitizing dye material, said sensitizing coloring material comprising a mixture of a sensitizing dye component (A) consisting of at least one compound of the formula (I) and a sensitizing dye component (B) consisting of at least one compound selected from those of the formula (II):

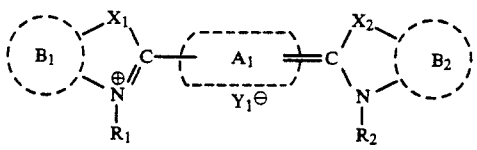

(I)

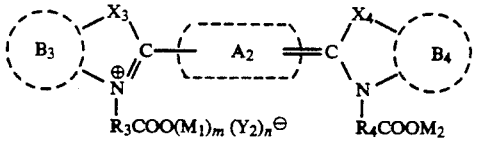

(II)

in which formulae (I) and (II), $A_1$ and $A_2$ respectively and independently represent a polymethine chain group having 5 to 7 carbon atoms, and non-substituted or substituted with at least one substituent, in which substituted polymethine chain group, two of the substituents may form, together with three carbon atoms in the polymethine chain group, a cyclic structure including 6 or more carbon atoms bonded to each other, $B_1$, $B_2$, $B_3$ and $B_4$ respectively and independently represent a member selected from the group consisting of divalent benzene and naphthalene groups non-substituted or substituted with at least one substituted, $X_1$, $X_2$, $X_3$ and $X_4$ respectively and independently represent a member selected from S, Se, and O atoms and $-(CH_3)_2$-group, $R_1$, $R_2$, $R_3$ and $R_4$ respectively and independently represent an alkyl group having 1 to 5 carbon atoms, $M_1$ and $M_2$ respectively and independently represent a member selected form the group consisting of metal atoms, organic bases and a hydrogen atom, $Y_1$ and $Y_2$ respectively and independently represent an anion, and m and n respectively and independently represent zero or an integer of one but when n is an integer of one, m is an integer of one, and when n is zero, m is also zero and the $-R_3COO$ group adjacent to the $(M_1)_m$ group in the formula (II) is anionic, the weight ratio of the sensitizing dye component (A) to the sensitizing dye component (B) being from 3:1 to 20:1 .

2. The electrophotographic lithograph printing plate material as claimed in claim 1, wherein the compound of the formula (I) is selected from the compound of the formulae (IV) to (IX):

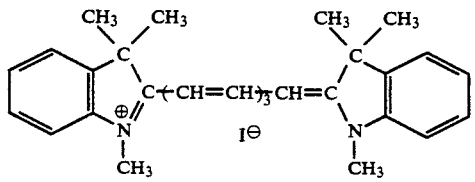

(IV)

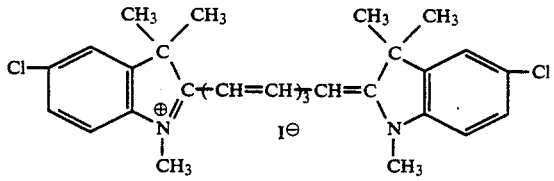

(V)

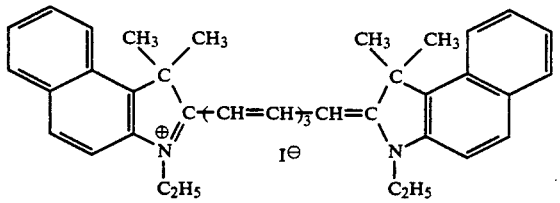

(VI)

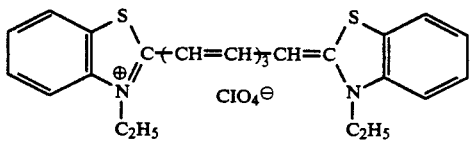

(VII)

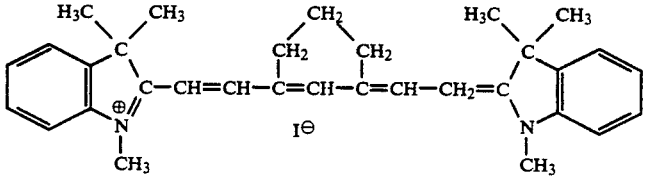

(VIII)

and

-continued
(IX)
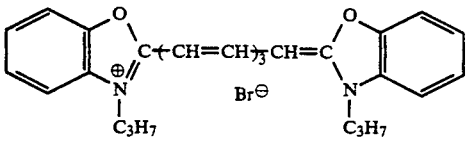
3. The electrophotographic lithograph printing plate material as claimed in claim 1, wherein the compounds of the formula (II) are selected from the formulae (X) to (XVII):
(X)
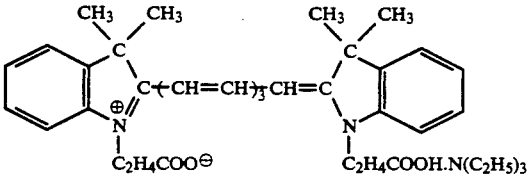
(XI)
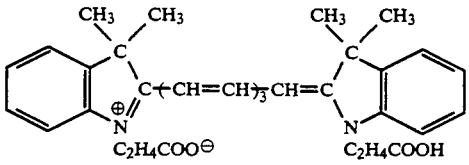
(XII)
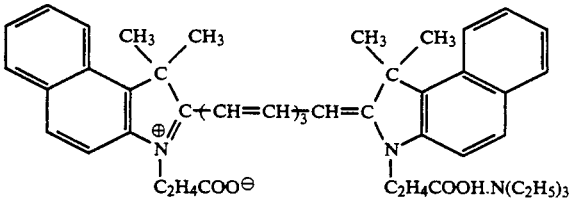
(XIII)
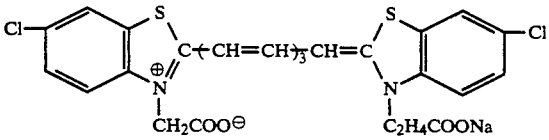
(XIV)
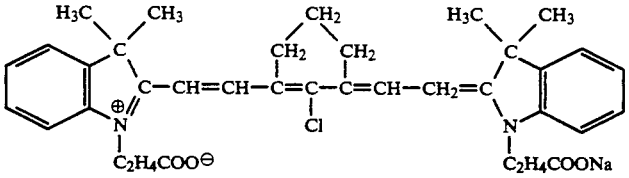
(XV)
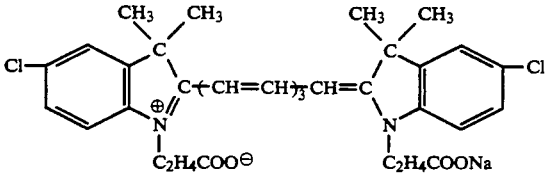
(XVI)
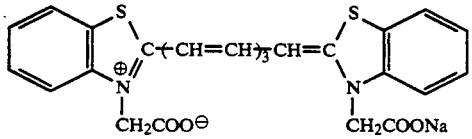
and -continued (XVII)

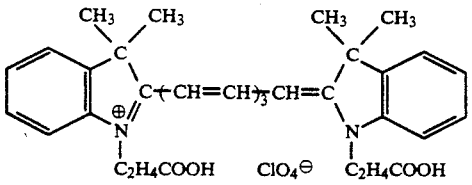

4. The electrophotographic lithograph printing plate material as claimed in claim 1, wherein the sensitizing dye components (A) and (B) are in a total amount of from 0.01 to 0.06% based on the dry solid weight of the electrophotographic layer.

5. The electrophotographic lithograph printing plate material as claimed in claim 1, wherein the photoconductive zinc oxide powder is in an amount of from 70 to 90% based on the dry solid weight of the electrophotographic layer.

6. The electrophotographic lithograph printing plate material as claimed in claim 1, wherein the resinous binder in the electrophotographic layer is in a dry solid weight of 10 to 30% based on the weight of the zinc oxide powder.

7. The electrophotographic lithograph printing plate material as claimed in claim 1, wherein the electrophotographic layer has a thickness of 5 to 25 μm.

* * * * *